US005435553A

United States Patent [19]

Arima et al.

[11] Patent Number: 5,435,553

[45] Date of Patent: Jul. 25, 1995

[54] CIRCUIT RACE TYPE GAME SYSTEM

[75] Inventors: Toshio Arima, Yokohama; Genzoh Watanabe, Tokyo, both of Japan

[73] Assignee: Namco Ltd., Tokyo, Japan

[21] Appl. No.: 20,395

[22] Filed: Feb. 22, 1993

[30] Foreign Application Priority Data

Feb. 24, 1992 [JP] Japan ..... 4-073349

[51] Int. Cl.[6] ..... A63F 9/14; G08B 23/00

[52] U.S. Cl. ..... 273/86 B; 273/442; 340/323 R

[58] Field of Search ..... 340/323 R; 273/37 J, 273/86 R, 442, 86 B, 86 F, 86 R; 472/85

[56] References Cited

U.S. PATENT DOCUMENTS

| | | | |
|---|---|---|---|
| 3,946,312 | 3/1976 | Oswald | 472/85 X |
| 4,334,221 | 6/1982 | Rosenhagen | 273/86 BX |
| 4,857,886 | 8/1989 | Crews | 340/323 R |
| 5,138,589 | 8/1992 | Kimbel | 340/323 RX |
| 5,140,307 | 8/1992 | Rebetez et al. | 273/86 RX |
| 5,173,856 | 12/1992 | Purnell et al. | 340/323 RX |
| 5,194,843 | 3/1993 | Jones et al. | 340/323 R |

*Primary Examiner*—Jessica J. Harrison

*Attorney, Agent, or Firm*—Oliff & Berridge

[57] ABSTRACT

A circuit race type game system is played by a plurality of players while running game racing cars on a circuit course. The circuit course includes a plurality of position indicating markers located thereon. The game racing cars run on the circuit while detecting the position indicating markers. A play field includes a host computer which receives a marker detection signal from each of the game racing cars to grasp the state of that game racing car running on the circuit course. Lap time for each lap and final lap time required by each of the game racing cars from the start to the goal are computed by the host computer as running time, these computed values being then displayed on a display panel with the ranking of that game racing car.

9 Claims, 6 Drawing Sheets

10
12
40
32
14
16
22
20
18
A
B
C
D
24a
24b
24c
24d
26a
26b
26c
26d
28
30

CIRCUIT RACE TYPE GAME SYSTEM

BACKGROUND OF THE INVENTION

1. Field of the Invention

The present invention relates to a circuit race type game system and particularly to a circuit racing system which can be played by a plurality of players while running game racing cars.

2. Description of the Related Art

There is known a circuit race type game system in which a plurality of players can get on and run racing cars along a circuit course. In such a circuit race type game system, the players can contend for precedence in addition to the enjoyment of actually driving the racing cars. Therefore, such game systems are broadly popular in amusement parks, exhibition grounds and so on.

In such game systems, lap time is also an important factor to increase the pleasure of game.

However, the circuit race type game systems of the prior art can only contend for ranking, rather than for lap time, lacking a further realism.

Particularly, in a game system of such a type that players run their racing cars along a circuit course through a predetermined number of laps, it can be enjoyed by the players with excitement and realism approximating to an actual race if the lap times of the respective players are indicated. However, the inventors do not know such a game system.

SUMMARY OF THE INVENTION

It is therefore an object of the present invention to provide a circuit race type game system which can be played by a plurality of players that run game fading cars while contending For ranking and lap time, thereby providing excitement and realism approximating to an actual circuit race.

To this end, the present invention provides a circuit race type game system comprising a play field in which a circuit course is formed, position indicating marker means disposed in said circuit course at at least one given location, a plurality of game racing cars each of which can receive a player and run on said play field, a marker detecting sensor on each of said game racing cars for detecting the passage of that game racing car at said marker means, vehicle transmitter means on each of said game racing cars for wirelessly transmitting the detection signal from said marker detecting sensor toward the circumference of said play field, central receiver means in said play field for receiving signals transmitted from the game racing cars, central processing means in said play field for computing a running time required by each of said game racing cars running from the start point to the passage of that game racing car at said marker means, using a detection signal that has been transmitted from said marker detecting sensor to said central processing means, and display means in said play field for displaying said running time in each of said game racing cars that runs on the circuit course, whereby the circuit race can be played by the players while displaying the running times of the game racing cars.

The present invention also provides a circuit race type game system comprising a play field in which a circuit course is formed, position indicating marker means disposed in said circuit course at at least one given location, a plurality of game racing cars each of which can receive a player and run on said play field, a marker detecting sensor on each of said game racing cars for detecting the passage of that game racing car at said marker means, vehicle computing means on each of said game racing cars for computing a running time required by that game racing car running from the start point to the passage of that game racing car at said marker means, using a detection signal from said marker detecting sensor, vehicle transmitter means on each of said game racing, cars for wirelessly transmitting said running time in that game racing car, central receiver means in said play field for receiving signals from said vehicle transmitter means, central processing means in said play field for computing the ranking based on the running time transmitted from each game racing car to said central receiver means, and display means in said play field for displaying said running time and ranking in each of said game racing cars, whereby the circuit race can be played by the players while displaying the running times and rankings of the game racing cars.

It is preferable that the position indicating marker means is disposed at the goal line in the circuit course so that the running time can be computed as a lap time for each lap and a final lap time required for each game racing car to run from the start line to the goal line.

Preferably, the circuit race type game system comprises central wireless transmitter means in said play field, vehicle receiver means in each of the game racing cars, central control means in said play field for grasping the running state in each of said game racing cars on the circuit course based on the passage detection signal or running time transmitted from each of said game racing cars to said central receiver means and for processing a running control signal used to lead that game racing car to a proper running state, said running control signal being wirelessly transmitted to each game racing car through said central transmitter means, and vehicle control means in each said game racing cars for controlling the running state of that game racing car based on the running control signal received by said vehicle receiver means.

In the circuit race type game system of the present invention, a plurality of players can run their own game racing cars on the circuit course.

As each of the game racing cars passes through a position adjacent to the position indicating marker on the circuit course, the marker detecting sensor on that game racing car detects this passage.

On the passage of each game racing car at the marker, the game system of the present invention computes a running time required by that game racing car to run from the start line to the marker, the running-time being then displayed in the display means.

Therefore, each player can play the circuit game while enjoying the running time of the game racing car driven by himself or herself. This can provide excitation and realism approximating to an actual circuit race.

Particularly, when the position indicating marker means is located at the goal line in the circuit course and if the running time is computed as a lap time for each lap and a final lap time required by each game racing car to run from the start line to the goal line, the players can play the circuit race while contending not only for ranking but also for lap time and final lap time.

The game system of the present invention may be adapted to grasp the running state in each game racing car on the circuit course and to control that game racing car so that it can be led to a proper running state on the circuit course. For example, if a game racing car of the second rank is too much separated from another game racing car of the first rank, the game system may be controlled to somewhat reduce the maximum speed in the first rank game racing car so that the distance between the first and second rank game racing cars will be decreased. This can increase the amusingness by intentionally generating a dead heat between the first and second rank game racing cars. Further, if a plurality of game racing cars gather into a mass in a running section, the maximum speed of each of the gathered game racing cars may be caused to differ from those of the other game racing cars such that the mass of the gathered game racing cars will be overcome spontaneously.

DETAILED DESCRIPTION OF THE PREFERRED EMBODIMENTS

Figure 1:
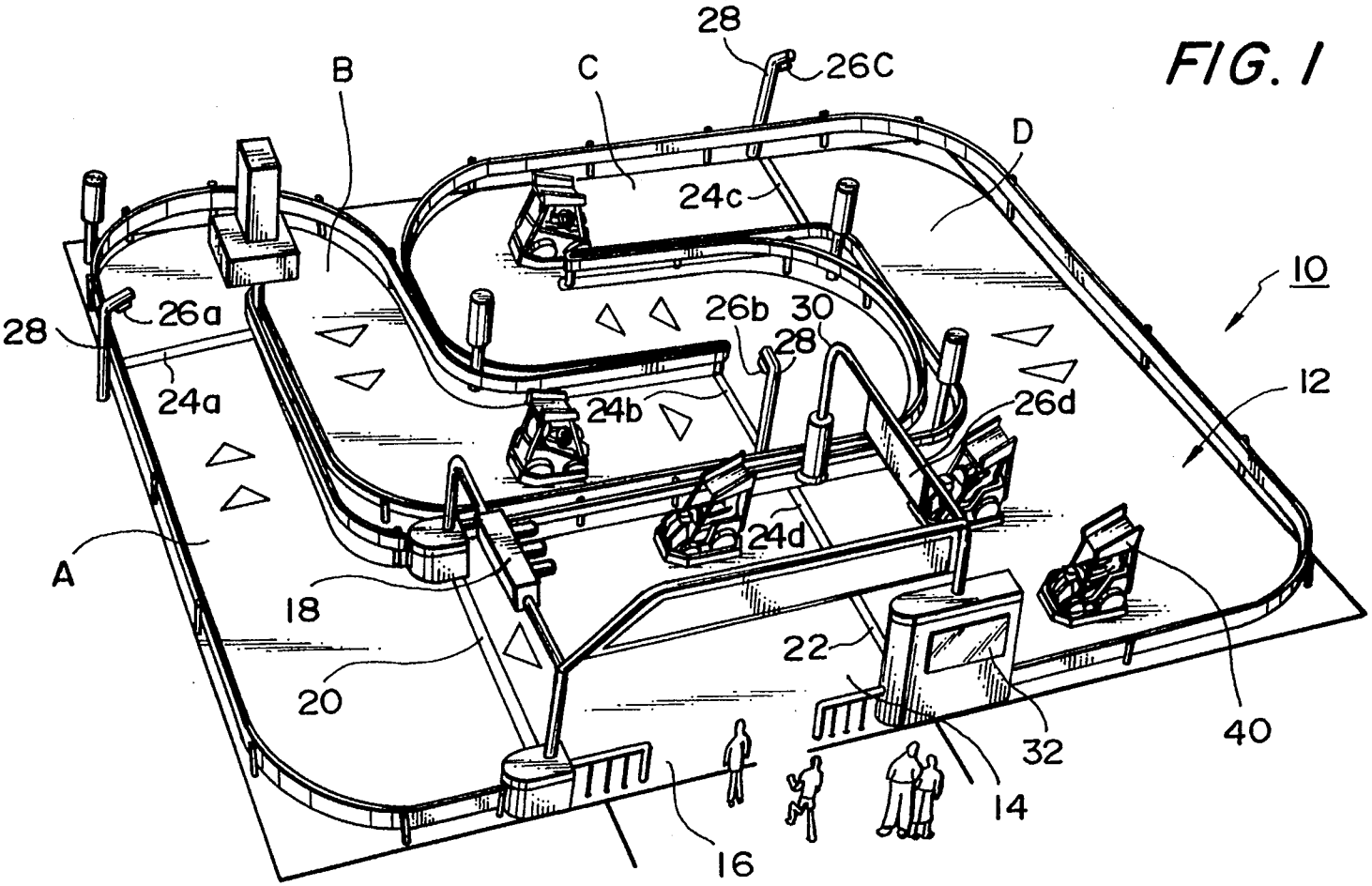
FIG. 1 is a perspective view of one preferred embodiment of a circuit race type game system constructed in accordance with the present invention.

Referring to FIG. 1, there is shown one embodiment of a circuit race type game system constructed in accordance with the present invention. The game system comprises a play field 10 and a circuit course 12 formed on the play field 10. A plurality of racing cars 40 are operated by players to run on the circuit course. The circuit course 12 is in the form of an endless course, part of which includes a transfer zone 14 located between a start line 20 and a goal line 22.

A player can enter the transfer zone 14 through a gateway 16 and get on a game racing car. When a start signal 18 is changed from red to blue, the player can start his or her game racing car 40 from the start line 20 and run on the circuit course 12 through a predetermined number of laps (three laps in the illustrated embodiment) toward the goal line 22. After finished the game, the player gets down the game racing car 40 at the transfer zone 14 and exits the play field 10 through the gateway 16.

The circuit course 12 includes a plurality of position indicating markers 24*a*, 24*b*, 24*c* and 24*d* located thereon. These markers divide the circuit course into four zones A, B, C and D. Each of the position indicating markers 24 is in the form of a metallic tape attached to the circuit course 12 in a direction perpendicular to the direction of movement of the racing cars. The marker 24*d* is mounted directly on the goal line 22.

The racing car 40 is adapted to run on the circuit course 12 while detecting the passage of the racing car at-the position indicating markers.

Figure 2:
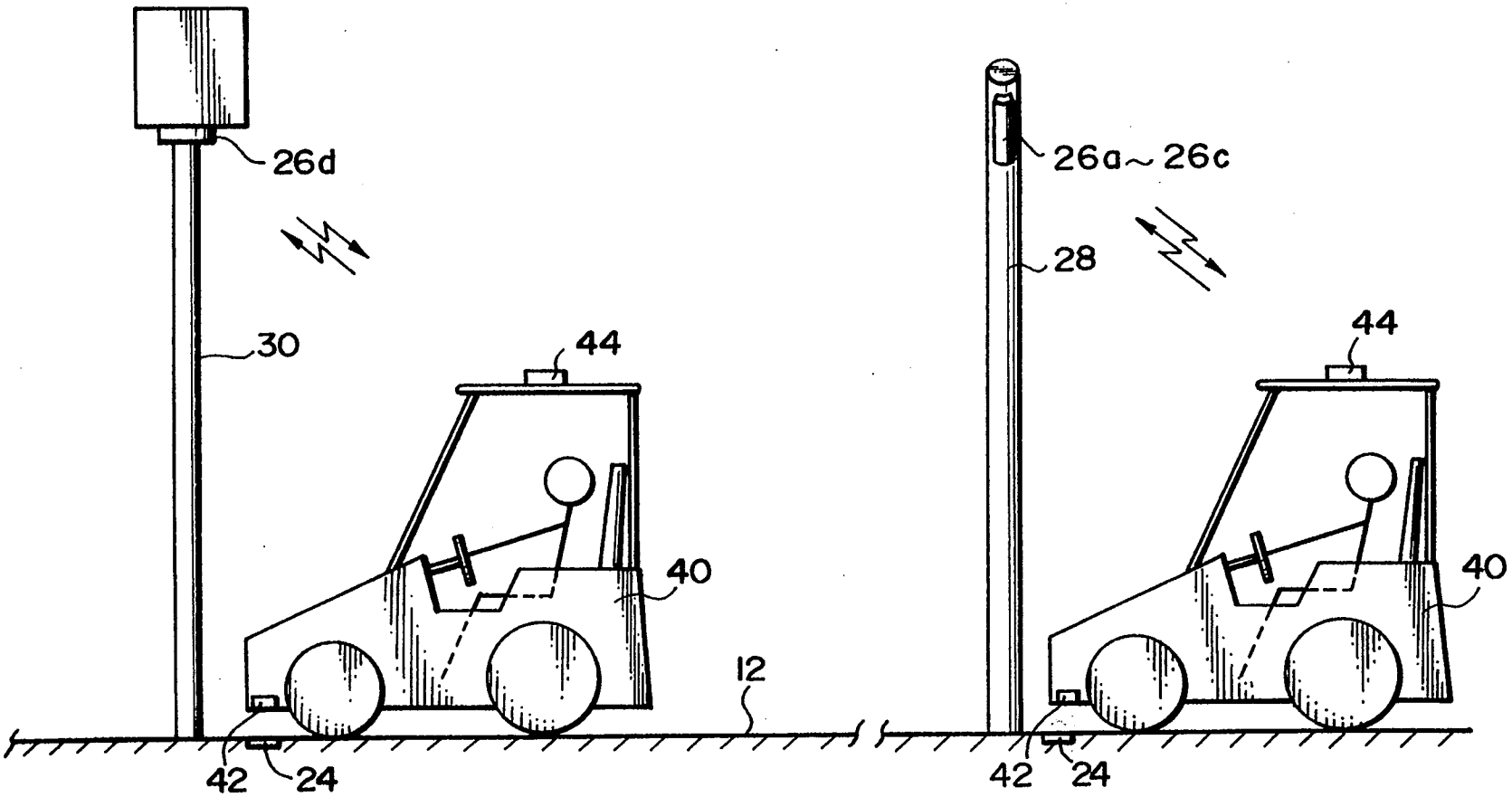
FIG. 2 is a schematic view illustrating racing cars which run on the circuit course shown in FIG. 1.

FIG. 2 schematically illustrates two racing cars 40 running on the circuit course 12. Each of the racing cars 40 includes a marker detecting sensor 42 for detecting the passage of that game racing car 40 at each marker. In the illustrated embodiment, the marker detecting sensor 42 is in the form of a proximity sensor mounted on the bottom of the game racing car to sense the proximity to the marker 24 since the latter is formed of metallic tape. Detection signal from the marker detecting sensor 24 is wirelessly transmitted to second infrared-ray transmitting and receiving units 26*a*, 26*b*, 26*c*and 26*d* located around the circumference of the circuit course 12 through a first infrared-ray transmitting and receiving unit 44 on the game racing car 40.

Each of the second infrared-ray transmitting and receiving units is fixedly mounted on the top of a pole 28 which stands at a position adjacent to the associated one of the position indicating markers 24*a*, 24*b* and 24*c*. The second infrared-ray transmitting and receiving unit 26*d* is fixedly mounted on an arcade-shaped pole 80 adjacent to the goal line 22. Each of the infrared-ray transmitting and receiving units 26*a*, 26*b*, 26*c* and 26*d* surely performs the transmission and reception of signals between that infrared-ray transmitting and receiving unit and the associated game racing car 40 as the latter passes through a position indicating marker 24.

The transmission and reception between the first and second infrared-ray transmitting and receiving units is performed using an ID code for specifying a particular game racing car 40.

The play field 10 includes a host computer (central computing and controlling circuit 38) which can grasp the states of the racing cars 40 running on the circuit course 12, based on the passage detection signals transmitted from the racing cars 40. The host computer also computes the running time of each of the racing cars 40 as a lap time for each lap and a final lap time from the start to the goal. These computed times are displayed with the ranking on a large display panel 32 which is located adjacent to the transfer zone 14. A plurality of such display panels 32 may be located so as to be viewed not only by the running players but also by waiting persons.

Figure 3:
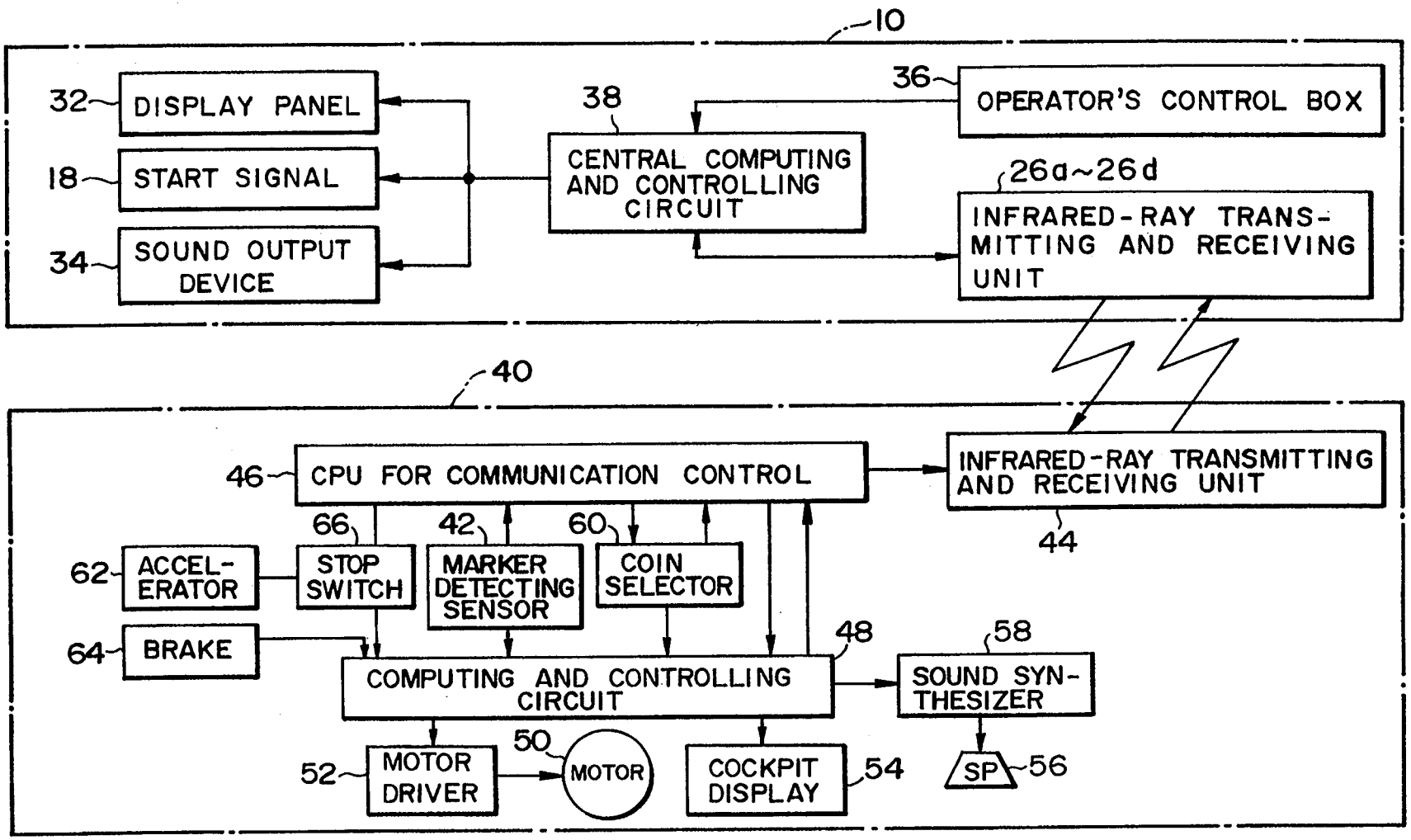
FIG. 3 is a block diagram of the primary parts of the game system shown in FIG. 1.

Referring to FIG. 3, there is shown a circuit which is used in the circuit race type game system shown in FIGS. 1 and 2. The circuit comprises a communication control CPU 46 for controlling the first infrared-ray transmitting and receiving units 44 on the racing cars 40, a computing and controlling circuit 48, motor and motor driver 50, 52 for driving each of the racing cars 40, a cockpit display 54 on each of the racing cars 40, speaker and sound synthesizing circuit 56, 58 for outputting sound information, a coin selector 60 on each of the racing cars 40 for counting coins inserted into a slot, accelerator and brake 62, 64 on each of the racing cars 40 for accelerating and decelerating the game racing car, and an emergency stop switch 66 on each of the racing cars.

The computing and controlling circuit 48 is adapted to control all the racing cars 40. As a player operates the accelerator and brake 62, 64 on his or her game racing car, the computing and controlling circuit 48 receives signals from that game racing car to control the motor driver 52 so that the number of revolutions in the motor 50. The computing and controlling circuit 48 further receives signals from the coin selectors 60, the marker detecting sensors 42 and the communication control CPU 46 to control the cockpit displays 54 and to control the sound synthesizing circuit 58 for causing the speakers 56 to output the desired sound.

The communication control CPU 46 in each of the racing cars 40 wirelessly transmits signals from the marker detecting sensor 42, coin selector 60 and computing and controlling circuit 48 to the corresponding infrared-ray transmitting and receiving unit 26 in the play field 10 through the infrared-ray transmitting unit 44, with the ID code for identifying that game racing car. The communication control CPU 46 further discriminates any ID code contained in data that is transmitted from the corresponding infrared-ray transmitting and receiving unit 26 of the play field 10 to that game racing car. If it is judged that the transmitted ID code is its own ID code, the communication control CPU 46 outputs the transmitted data to the computing and controlling circuit 48, coin selector 60 and/or emergency stop switch 66, depending on its content.

The play field 10 further comprises an operator's control box 36, a central computing and controlling circuit 38 and a sound output device 34.

The central computing and controlling circuit 38 is in the form of a host computer which is adapted to receive signals from the respective racing cars through the infrared-ray transmitting and receiving units 26 to control the entire circuit race.

For example, when the central computing and controlling circuit 38 receives a detection signal from the coin selector 60 in a game racing car 40 with its ID code, it allows the entry of that game racing car 40 to the circuit race. In the illustrated embodiment, the central computing and controlling circuit 38 is adapted to allow the entry of racing cars up to eight. The entry game racing car numbers are displayed on the display panel 32 in the order of entry.

As the operator starts the game through the operator's control box 36, the central computing and controlling circuit 38 causes the sound output device 34 to output a countdown voice till the game start and controls the start signal 18 so that it will be changed from red color to blue color at the same time as the game start.

After the game start, the central computing and controlling circuit 38 grasps the running states of the respective racing cars 40 on the circuit course, based on the marker detection signals representing the passage of the racing cars at the markers which are transmitted from the respective racing cars to the infrared-ray transmitting and receiving units 26. More particularly, the central computing and controlling circuit 38 is responsive to each ID code associated with the marker detection signal to specify a game racing car 40 and also to judge which marker that game racing car 40 passed through, based on by which infrared-ray transmitting and receiving unit **26*a*, 26*b*, 26*c* or 26*d* the marker detection signal is received. At each time when a game racing car 40 passes through the marker 24*d* on the goal line 22, the central computing and controlling circuit 38 computes the lap time and ranking of that game racing car 40. When the game racing car 40 passes through the goal line 22 after it has run on the circuit course 12 a predetermined number of laps (three laps), the central computing and controlling circuit 38 computes the final lap time from the start to the goal and the ranking of that game racing car 40. The computed data is displayed on the large display panel 32 which is located adjacent to the transfer zone 14. Further, the lap time, final lap time and ranking of a game racing car 40 are wirelessly transmitted from the infrared-ray transmitting and receiving unit 44 to the infrared-ray transmitting and receiving unit 44 of that game racing car 40, with its ID code. As the game racing car 40 receives the data specified by the ID code, the lap time, final lap time and ranking of the game racing car 40 are displayed on its cockpit display 54**, if necessary.

Figure 4:
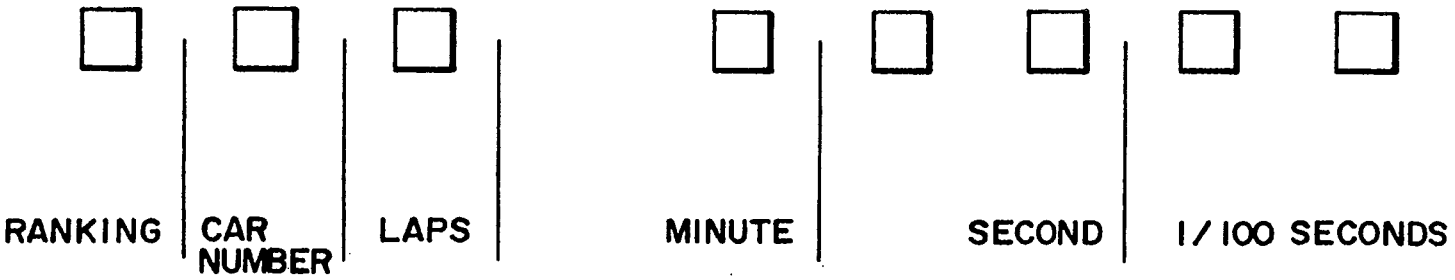
FIG. 4 is a view exemplifying several items which may be shown in the display.

FIG. 4 exemplifies data which are displayed on the display panel 32 and cockpit display 54. In the illustrated embodiment, the cockpit display 54 indicates only the data of a game racing car on which it is mounted while the display panel 32 shows the data of all the eight racing cars.

Figure 5:
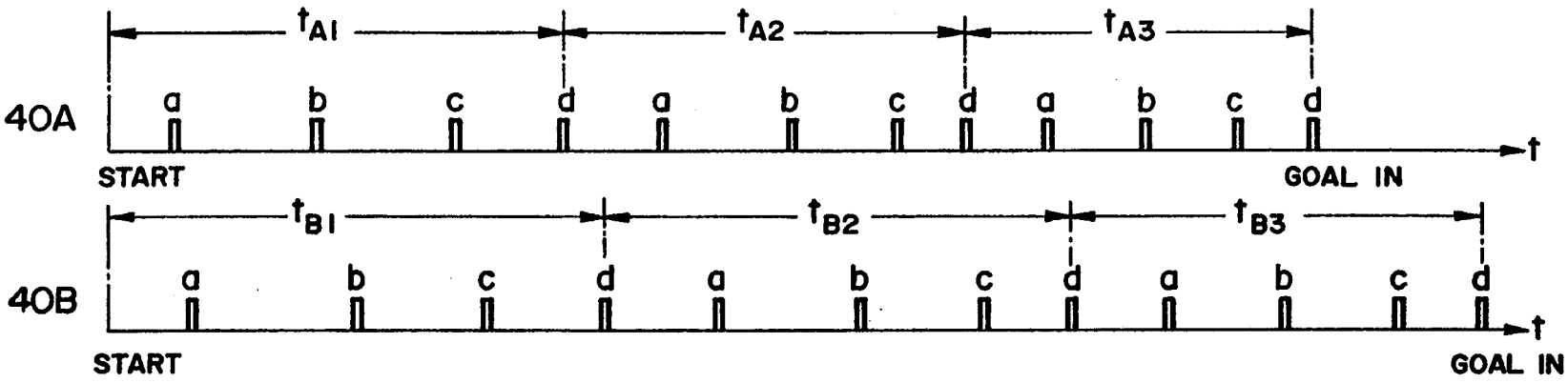
FIG. 5 is a timing chart illustrating detection signals which represent the passage of the respective racing cars at markers.

The central computing and controlling circuit 38 is further responsive to the marker detection signals from the racing cars 40 to grasp the running states of all the racing cars 40 on the circuit course 12. FIG. 5 shows a timing chart illustrating the marker detection signals from racing cars. In FIG. 5, letters a, b, c and d correspond to the position indicating markers **24*a*, 24*b*, 24*c* and 24*d*, respectively. As will be apparent from the timing chart, the central computing and controlling circuit 38 receives signals from the racing cars 40 to grasp on which zone A, B, C or D each game racing car 40 runs in the circuit course 12. Further, when there are a plurality of racing cars 40 in the same zone, the differences in running time between one racing car 40 and the other racing cars 40 can be grasped by the central computing and controlling circuit. Thus, the central computing and controlling circuit 38 can control all the racing cars 40 so that they run on the circuit course 12** under a proper condition.

For example, if a plurality of racing cars 40 run on the circuit course 12 in a mass, the central computing and controlling circuit 38 can set the racing cars 40 at different maximum speeds to overcome the mass of the racing cars 40 spontaneously. For example, when eight racing cars 40 run on the circuit course and if six racing cars 40 among them run on the zone B of the circuit course in a mass, the central computing and controlling circuit 38 can wirelessly transmit control signals for setting the six racing cars 40 at different maximum speeds to the respective racing cars 40 with their ID codes. When each of the six racing cars 40 receives the control signal specified by its own ID code, its computing and controlling circuit 48 controls to set the maximum speed at a level depending on that control signal. For example, if the maximum speed of each of the racing cars 40 is 30 km/hour, the maximum speed of a game racing car may controlled to be maintained 30 km/hour while the maximum speed of another game racing car 40 may be controlled to be set at 25 km/hour. Thus, the mass of the racing cars can be overcome spontaneously. The players can effectively utilize the circuit course with the smooth runs. The central computing and controlling circuit 38 then judges whether or not the mass of the racing cars 40 was overcome, based on the signals transmitted from the racing cars 40 to the central computing and controlling circuit 38. When the mass of the racing cars is overcome to some degree, the central computing and controlling circuit 38 can wirelessly transmit control signals for returning the maximum speeds of the racing cars 40 to their normal levels.

Alternatively, the mass of the racing cars may be overcome in any other manner, for example, in such a manner that the central computing and controlling circuit 38 grasps how many racing cars 40 run on the respective zones A, B, C and D of the circuit course 12 and then controls the speeds of all the racing cars 40 so that too many racing cars will not run on the same zone of the circuit course.

In the illustrated embodiment, the central computing and controlling circuit 38 can judge how much difference of time is between a game racing car and any succeeding game racing car. For example, if a game racing car of the second ranking is too much separated from another game racing car of the first ranking, the game racing car of the first ranking may be reduced in maximum speed. Thus, the spacing between the racing cars of the first and second rankings can be decreased to provide a more tense race.

The operator's control box 36 also includes an emergency stop button. If the emergency stop button is depressed by the operator, the central computing and controlling circuit 38 wirelessly transmits an emergency stop signal to all the racing cars 40 through the infrared-ray transmitting and receiving units 26. Each of the racing cars 40 receives such an emergency stop signal to actuate its own emergency stop switch 66 which in turn stops the motor 50. Thus, the racing game can be carried out with safety supervision.

Figure 6:
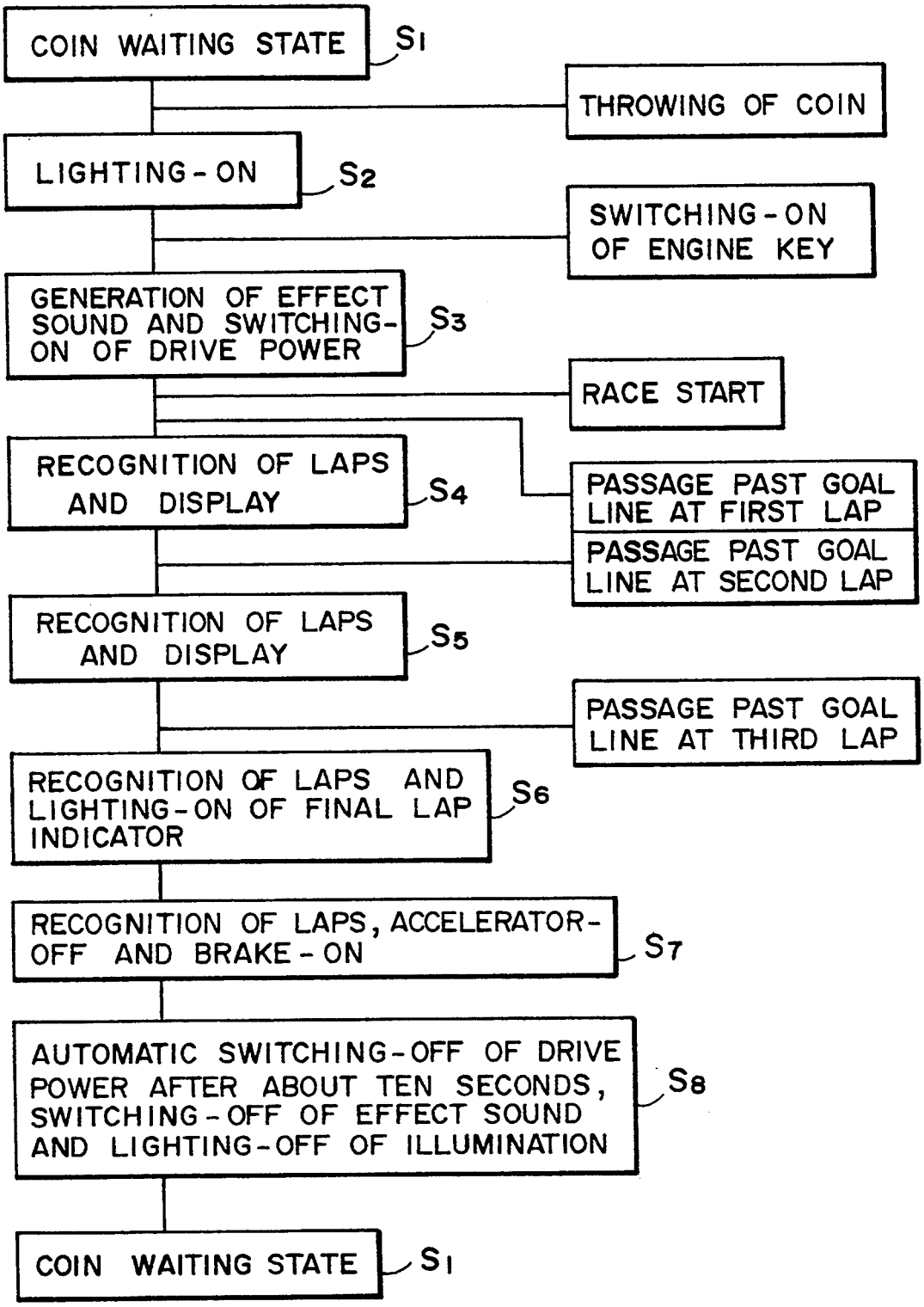
FIG. 6 is a flowchart illustrating the operation of the circuit race type game system shown in FIG. 1.

FIG. 6 shows a flowchart illustrating the operation of the aforementioned circuit race type game system constructed in accordance with the present invention.

When the race is not carried out, the racing cars 40 are collected in the transfer zone 14 wherein the players can get on the racing cars 40. At this time, each of the racing cars 40 is in coin waiting state (S1). When a player inserts a given coin into his or her game racing car through the coin slot, this is detected by the coin selector 60 which in turn generates a detection signal used to energize the cockpit display 54 and other illuminations (S2). The coin detection signal is further wirelessly transmitted to the central computing and controlling circuit 38 with a given ID code which is recognized to be an entry signal to the race.

At this time, the result of the preceding race displayed on the display panel 32 is cleared at the same time as the entry of a first game racing car is established. The numbers of the entry racing cars are then displayed on the display panel 32 in the order of entry reception.

After the reception of entry, each player turns on the engine key in its own game racing car. The speaker 56 then outputs effects sounds such as engine sound and other sounds. The operator turns on the power switch in the operator's control box 36 to lead the entry racing cars 40 to the grid (S3).

As the operator depresses the start button in the operator's control box 36 after he or she has confirmed the safety in the circuit course, the central computing and controlling circuit 38 controls the sound output device 34 to initiate the countdown. At the start, the start signal 18 is changed from red color to blue color while the measurement of lap time in each of the racing cars 40 is initiated.

At the same time, the time indicator on the display panel 32 initiates to display the time elapsed.

After the top game racing car 40 has first passed through the goal line 22, the data is processed to cause the machine numbers and first lap times of the respective racing cars to be displayed on the display panel 32 in the order of precedence. Such a display is first made in a flashing manner for three or five seconds and returned to its normal lighting state. At the same time, the first lap time and number of laps in each of the racing cars 40 are displayed on the cockpit display 54 thereof.

Similarly, as the top game racing car 40 passes through the goal line 22 in the second lap, the machine number, lap time, total time required to make the first and second laps and number of laps in each of the racing cars are displayed on the display panel 32 in the order of preference (S4 and S5).

As the top game racing car 40 passes through the goal line 22 in the third lap, the machine number, lap time and total time required in the first to third laps in each game racing car are displayed in the order of preference. This display is first made in a flashing manner for three or five seconds and then returned to its normal lighting state (S6).

As a game racing car 40 finally passes through the goal line 22, the central computing and controlling circuit 38 transmits a control signal to that game racing car 40 so that the accelerator 62 is turned off and the brake 64 is turned on. The game racing car 40 can stop the transfer zone 14 (S7).

After about ten seconds, the cockpit display 54 in that game racing car 40 is automatically turned off with the speaker 56 (S8). The game racing car 40 is then in its coin waiting state.

In the illustrated embodiment, a plurality of racing cars 40 can be driven by the players while contending not only the ranking but also the lap time and total running time. Thus, the circuit race type game system of the present invention can be played by the players with realism and amusingness approximating to an actual circuit race.

During the circuit race, the central computing and controlling circuit 38 can grasp the running state of each of the racing cars 40 on the circuit course 12 and control all the racing cars 40 so that the racing cars will not run in a mass. Furthermore, if a game racing car is too much separated from another game racing car, for example, if a game racing car of the second ranking is too much separated from a game racing car of the first ranking, the maximum speed of the respective game racing car can be controlled to decrease the spacing between these two racing cars. This also serves to provide a more tense racing game.

It is to be understood that the present invention is not limited to the illustrated configuration, but may be carried out in many modifications and changes without departing from the scope of the invention.

For example, the computing and controlling circuit 48 in each of the racing cars 40 may compute its own running time which in turn is wirelessly transmitted to the central computing and controlling circuit 38 in the play field 10. In such a case, the central computing and controlling circuit 38 wirelessly transmits the start signal to the respective racing cars 40 at the same time as the circuit race is initiated.

At the same time as the computing and controlling circuit 48 receives the start signal, it initiates the measurement of time. Each time when the marker detecting sensor 42 senses a marker, the time elapsed is determined as a running time. The measured time, marker detection signal and ID code are wirelessly transmitted to the central computing and controlling circuit 38.

On reception of these signals, the central computing and controlling circuit 38 can grasp the running time in each of the racing cars 40 and display them on the display panel 32, as in the previously described embodiment.

Although the embodiment has been described as to the infrared-ray transmitting and receiving units used as wireless transmitter and receiver means, the present invention may be applied to any wireless transmission and reception system using weak radio wave.

The position indicating markers in the form of metallic tape may be replaced by any other suitable means such as reflective tape. In such a ease, the marker detecting sensor 42 is replaced by a light transmission and reception unit which optically senses the reflective tape.

Furthermore, the present invention may be applied to decorations or other matters adjacent to the circuit course which can be varied in production depending on the preference of the respective racing cars 40 in lap time.

Since the circuit race type game system of the present invention can be played by a plurality of players while displaying the running time of each of the racing cars, it can provide realism and amusingness approximating to an actual circuit race.

When a position indicating marker is located at the goal line in the circuit course and even if a plurality of racing cars run on the circuit course, the lap time for each lap and final lap time required from the start to the goal in each of the racing cars can be displayed as its running time. This further improves the realism and amusingness in the circuit race.

The circuit race type game system of the present invention can grasp the state of each game racing car running on the circuit course and control the game racing car to run on the circuit course in a proper running state.

We claim:

1. A circuit race type game system comprising:

a play field having a circuit course;

a plurality of racing cars each adapted to travel over said circuit course;

detecting means for detecting data of said racing cars at locations over said circuit course;

computing and controlling means, installed in said play field, for receiving the data detected by said detecting means, for recognizing an actual travelling condition of at least one racing car based on the detected data, for computing a desired travelling condition of the at least one racing car, and for wirelessly transmitting the desired travelling condition to the at least one racing car; and onboard control means, located on each racing car, for controlling the actual travelling condition of said at least one racing car based on said desired travelling condition transmitted to said at least one racing car.

2. The circuit race type game system of claim 1, wherein said desired travelling condition is a speed of said at least one racing car.

3. The circuit race type game system of claim 2, wherein the computing and control means computes the speed of said at least one racing car so that a number of racing cars in each of a plurality of zones of said circuit course is less than a predetermined number.

4. The circuit race type game system of claim 2, wherein said computing and control means computes the speed of said at least one racing car to control a distance between said at least one racing car and one other racing car.

5. The circuit race type game system of claim 2, wherein the speed is a maximum speed of said at least one racing car.

6. The circuit race type game system of claim 5, wherein said computing and control means computes the maximum speed for the at least one racing car when the data detected by said detecting means indicates that said racing cars are in a jammed condition.

7. The circuit race type game system of claim 5, wherein said computing and control means computes the maximum speed of the at least one racing car to control a maximum number of said racing cars in each of a plurality of zones of said circuit course.

8. The circuit race type game system of claim 5, wherein said maximum speed of said at least one racing car is computed by said computing and control means to control a distance between said at least one racing car and another one of said racing cars.

9. The circuit race type game system of claim 1, further comprising a stop button communicating with said computing and controlling means, wherein said computing and controlling means senses activation of said stop button and establishes said desired travelling condition as a stop condition.

* * * * *